US007553350B2

(12) United States Patent
Kuroda et al.

(10) Patent No.: US 7,553,350 B2
(45) Date of Patent: Jun. 30, 2009

(54) HIGH-STRENGTH AND HIGHLY-WEAR-RESISTANT SINTERED DIAMOND OBJECT AND MANUFACTURING METHOD OF THE SAME

(75) Inventors: Yoshihiro Kuroda, Itami (JP); Satoru Kukino, Itami (JP); Tomohiro Fukaya, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 405 days.

(21) Appl. No.: 10/580,152

(22) PCT Filed: Jul. 26, 2005

(86) PCT No.: PCT/JP2005/013621

§ 371 (c)(1),
(2), (4) Date: May 19, 2006

(87) PCT Pub. No.: WO2007/013137

PCT Pub. Date: Feb. 1, 2007

(65) Prior Publication Data

US 2008/0066388 A1 Mar. 20, 2008

(51) Int. Cl.
*C22C 26/00* (2006.01)
*C22C 1/04* (2006.01)

(52) U.S. Cl. ..... 75/236; 75/242; 75/243; 419/11; 419/14; 419/23; 419/48; 51/307; 51/309

(58) Field of Classification Search ..... 75/236, 75/242, 243; 51/307, 309; 419/11, 14, 23, 419/48

See application file for complete search history.

(56) References Cited

U.S. PATENT DOCUMENTS

| | | | | |
|---|---|---|---|---|
| 4,171,973 | A | 10/1979 | Hara et al. | |
| 4,231,762 | A * | 11/1980 | Hara et al. | 51/309 |
| 4,303,442 | A * | 12/1981 | Hara et al. | 75/243 |
| 4,374,900 | A * | 2/1983 | Hara et al. | 428/551 |
| 4,525,178 | A * | 6/1985 | Hall | 51/309 |
| 4,828,611 | A * | 5/1989 | Nakai et al. | 75/237 |
| 5,759,216 | A * | 6/1998 | Kanada et al. | 51/309 |
| 6,261,329 | B1 | 7/2001 | Ogata et al. | |

FOREIGN PATENT DOCUMENTS

| | | |
|---|---|---|
| JP | 39-020483 | 9/1964 |
| JP | 52-012126 | 4/1977 |
| JP | 55-047363 | 4/1980 |
| JP | 58-032224 | 7/1983 |
| JP | 61-270258 | 11/1986 |
| JP | 61-058432 | 12/1986 |
| JP | 64-017836 | 1/1989 |
| JP | 06-006769 | 1/1994 |
| JP | 06-305833 | 11/1994 |
| JP | 09-316587 | 12/1997 |
| JP | 11-240762 | 9/1999 |
| JP | 2003-095743 | 4/2003 |
| RU | 2 068 318 C1 | 10/1996 |
| SU | 602586 A1 | 4/1978 |

OTHER PUBLICATIONS

Russian Notice of Allowance, w/ English translation thereof, issued in Patent Application No. 2006116265/15(017655) dated on Jul. 29, 2008.

* cited by examiner

*Primary Examiner*—Roy King
*Assistant Examiner*—Ngoclan T Mai
(74) *Attorney, Agent, or Firm*—McDermott Will & Emery LLP

(57) ABSTRACT

A high-strength and highly-wear-resistant sintered diamond object according to the present invention includes sintered diamond particle having an average particle size of not larger than 2 μm and a binder phase as a remaining portion. The content of the sintered diamond particle in the sintered diamond object is not smaller than 80 volume % and not larger than 98 volume %. The binder phase contains at least one element selected from the group consisting of titanium and the like, of which content is not smaller than 0.5 mass % and less than 50 mass %, and contains cobalt, of which content is not smaller than 50 mass % and less than 99.5 mass %. A part of the element or the element as a whole is present as carbide particle having an average particle size of not larger than 0.8 μm. A texture of the carbide particle is discontinuous, and adjacent diamond particles are bound to each other. The sintered diamond object attaining excellent wear resistance, chipping resistance, shock resistance, and thermal conductivity can thus be obtained.

7 Claims, 2 Drawing Sheets

HIGH-STRENGTH AND HIGHLY-WEAR-RESISTANT SINTERED DIAMOND OBJECT AND MANUFACTURING METHOD OF THE SAME

RELATED APPLICATION

This application is a national phase of PCT/JP2005/013621 filed on Jul. 26, 2005 the disclosures of which application are incorporated by reference herein. The benefit of the priority date of the International Application is respectfully requested.

TECHNICAL FIELD

The present invention relates to a high-strength and highly-wear-resistant sintered diamond object and a method of manufacturing the same, and more particularly to a cutting tool represented by a turning tool, a milling tool and an end mill, to a wear-resistant tool representatively used for reinforcing a cramp portion or a sliding portion in drawing dies or machine tool, and to application in an electronic material such as an electrode part, that attains excellent wear resistance, chipping resistance, shock resistance, and thermal conductivity.

BACKGROUND ART

As diamond is the hardest substance among those present on earth, a sintered diamond object is used in a cutting tool or a wear resistant tool. For example, Japanese National Patent Publication No. 39-020483 (Patent Document 1) and Japanese National Patent Publication No. 52-012126 (Patent Document 2) disclose a sintered diamond object obtained by sintering diamond particles with a binder composed of an iron-group metal such as Co (cobalt). In the sintered diamond object, chipping due to cleavage which is a disadvantage of monocrystalline diamond is less likely. Therefore, the sintered diamond object is widely used as a raw material for a cutting tool or the like for cutting and working a non-ferrous metal material such as an Al (aluminum)-Si (silicon) alloy.

The sintered diamond object containing diamond particle having an average particle size of not smaller than 5 μm and not larger than 100 μm attains excellent wear resistance. Meanwhile, the sintered diamond object containing fine diamond particle having an average particle size of less than 5 μm attains excellent chipping resistance. As in the case of common sintered ceramics, as the sintered diamond object contains the diamond particles having a finer and uniform particle size in a higher content (high density) and the particles are more firmly bound to each other, the diamond particle being hard particle constituting the sintered diamond object, the sintered diamond object tends to attain more excellent chipping resistance.

As a method of firmly binding the diamond particles, Patent Document 1 mentioned above discloses a method of using a binder implemented by a solvent, the solvent represented by an iron-group metal such as Co, Fe (iron) or Ni (nickel) attaining a catalyst capability for dissolving diamond powder and causing the same to re-precipitate so as to form direct bond called neck growth between the diamond powders. In addition, Japanese National Patent Publication No. 58-032224 (Japanese Patent Laying-Open No. 55-047363) (Patent Document 3) discloses a method of binding the diamond particles by means of a binder composed of carbide of a 4a-, 5a- or 6a-group metal in the periodic table.

In the sintered diamond object manufactured with the former method of generating neck growth between the diamond particles using Co or WC (tungsten carbide)-Co alloy as the binder, unlike the sintered diamond object manufactured with the latter method, the diamond particles can maintain a firm structure, even after the binder being poorer in hardness or corrosion resistance than the diamond particle is selectively worn due to mechanical wear such as rubbing wear or chemical wear such as corrosion. Therefore, the sintered diamond object manufactured with the former method is excellent in chipping resistance and wear resistance.

The binder itself composed of Co or the WC-Co alloy in the former case has hardness lower than the ceramics type binder used in the latter method, to say nothing of comparison with the diamond particle. Namely, this binder is disadvantageous in its susceptibility to wear due to mechanical rubbing.

As such, in the sintered diamond object obtained by firmly sintering ultra-fine diamond particles having an average particle size of not larger than 1 μm by using the Co alloy as the binder while maintaining a uniform texture, if the content of the diamond particles can be increased such that the content of the binder composed of Co or WC-Co alloy can be minimized, an ideal sintered diamond object attaining extremely excellent chipping resistance as well as wear resistance can be obtained.

If sintering is performed by using ultra-fine diamond particle having the particle size of not larger than 1 μm and the iron-group metal such as Co or WC (tungsten carbide)-Co as starting materials, however, abnormal growth of the diamond particle tends to frequently occur, unless a temperature and pressure condition at the time of sintering is strictly controlled. This is because the ultra-fine diamond particle is highly reactive. In addition, if a high temperature condition, which is important in promoting neck growth, is set and if diamond particle having the particle size of not larger than 2 μm is used as the starting material, abnormal particle growth is inevitable, and the sintered object including an abnormally grown particle portion cannot be cut with EDM (Electrical Discharge Machining). Moreover, mechanical strength of the diamond is also lowered due to generation of defects. Therefore, it is difficult to achieve high yield of the sintered diamond object having a particle size of not larger than 1 μm and a uniform texture.

As a method of suppressing abnormal growth of the diamond particle, a method of controlling abnormal particle growth by arranging hard particle such as WC, cBN (cubic boron nitride), SiC (silicon carbide) having hardness as high as the diamond at a grain boundary of the diamond particle is known. Such a method is disclosed, for example, in Japanese National Patent Publication No. 61-058432 (Patent Document 4), Japanese National Patent Publication No. 06-006769 (Japanese Patent Laying-Open No. 64-017836) (Patent Document 5), and Japanese Patent Laying-Open No. 2003-095743 (Patent Document 6).

Patent Document 1: Japanese National Patent Publication No. 39-020483

Patent Document 2: Japanese National Patent Publication No. 52-012126

Patent Document 3: Japanese National Patent Publication No. 58-032224 (Japanese Patent Laying-Open No. 55-047363)

Patent Document 4: Japanese National Patent Publication No. 61-058432

Patent Document 5: Japanese National Patent Publication No. 06-006769 (Japanese Patent Laying-Open No. 64-017836)

Patent Document 6: Japanese Patent Laying-Open No. 2003-095743

DISCLOSURE OF THE INVENTION

Problems to be Solved by the Invention

In the method described above, however, direct bond between the diamond particles is physically and chemically blocked by arranging hard particle having low affinity with the diamond particle between the diamond particles or by covering the whole surface of the diamond particle with the binder not having capability as a catalyst (dissolution and re-precipitation) for the diamond particle, so as to suppress abnormal growth of the diamond particle. Accordingly, structure formation as a result of neck growth of the diamond particles is insufficient. Consequently, natural mechanical and thermal characteristic of the diamond is deteriorated, and chipping resistance, shock resistance, wear resistance, and thermal conductivity of the sintered diamond object is lowered.

From the foregoing, an object of the present invention is to provide a sintered diamond object attaining excellent chipping resistance, shock resistance, wear resistance, and thermal conductivity as well as a manufacturing method of the same.

Means for Solving the Problems

As a result of earnest study for achieving improvement in chipping resistance, wear resistance or the like of the sintered diamond object, the present inventors have found that strength such as chipping resistance or shock resistance, wear resistance and thermal conductivity of the sintered diamond object can be improved by strengthening the direct bond between the diamond particles. Then, the inventors have studied a method of suppressing abnormal particle growth by employing, instead of conventionally used hard particle, a new binder suppressing excessive dissolution of the diamond particle in the binder, while maintaining a catalysis (dissolution and re-precipitation) with respect to the diamond particle, as in the binder composed of Co or the WC-Co alloy.

Consequently, it has been found that, if fine diamond particle having an extremely large surface area is used as the starting material, diamond dissolves in Co serving as the binder abruptly in a large amount at the time of sintering, and carbon in the binder that instantaneously attained supersaturation is precipitated as thermodynamically stable diamond, which results in abnormal growth of the diamond particle. In order to prevent such abnormal particle growth, at least one element selected from the group consisting of Ti (titanium), Zr (zirconia), Hf (hafnium), V (vanadium), Nb (niobium), Ta (tantalum), Cr (chromium), and Mo (molybdenum) is added to Co serving as the binder, such that the content thereof is not smaller than 0.5 mass % and less than 50 mass %, a part of the element or the element as a whole is present as carbide having an average particle size of at most 0.8 μm, and a texture of the carbide particle is discontinuous. In this manner, fine carbide serves as getter and it is also dissolved in Co to some extent as carbide. Therefore, dissolution and precipitation of carbon as a simple substance in Co can be gradual. In addition, the element is controlled so as not to be continuous, so that neck growth among the diamond particles can more readily be achieved and a strong structure is formed. Furthermore, an amount of added binder is small, and the hard particle does not need to be added. Therefore, the content of diamond in the sintered diamond object is increased.

In the sintered object in which coarse diamond powder is used, the diamond particle is more readily sintered as a result of addition of the element to the binder. Therefore, addition of tungsten carbide as in the conventional example is not necessary, and wear resistance of the sintered diamond object can be improved.

In the sintered diamond object according to the present invention, particles of carbide are present discontinuously. In other words, the sintered diamond object does not have such a structure that carbide is directly bound to each other. As presence of carbide is less likely to block binding between the diamond particles, binding between the diamond particles can be strengthened.

In the sintered fine diamond object containing diamond having an average particle size of not larger than 2 μm in an amount of not smaller than 90 volume % as well, that could not be obtained without abnormal particle growth in the conventional method, it has been confirmed that, as the content of the diamond particle in the sintered diamond object is larger, wear resistance and chipping resistance of the sintered object is improved.

In addition, it has been found that a size of defect in the sintered object is closely related to strength such as chipping resistance and shock resistance of the sintered object. Here, the defect refers to a diamond particle having a remarkably large diameter in the sintered diamond object, a pool of the binder such as the solvent, a gap, or an area where binding (neck growth) between the diamond particles is insufficient (not bound or incomplete binding). As the defect in the sintered diamond object is smaller, the strength of the sintered object is increased.

A high-strength and highly-wear-resistant sintered diamond .object according to the present invention made based on these conceptions includes sintered diamond particle having an average particle size of at most 2 μm and a binder phase as a remaining portion. The content of the sintered diamond particle in the sintered diamond object is at least 80 volume % and at most 98 volume %. The binder phase contains at least one element selected from the group consisting of titanium, zirconium, hafnium, vanadium, niobium, tantalum, chromium, and molybdenum of which content is at least 0.5 mass % and less than 50 mass % and contains cobalt of which content is at least 50 mass % and less than 99.5 mass %. A part of at least one element or at least one element as a whole, the element being selected from the group consisting of titanium, zirconium, hafnium, vanadium, niobium, tantalum, chromium, and molybdenum, is present as carbide particle having an average particle size of at most 0.8 μm. A texture of the carbide particle is discontinuous, and adjacent diamond particles are bound to each other.

In such a sintered diamond object, at least one element selected from the group consisting of Ti, Zr, Hf, V, Nb, Ta, Cr, and Mo is added to the binder. Therefore, even if the diamond particle used as a material has a small diameter, abnormal growth of the particle can be suppressed without addition of the hard particle. In addition, even if the diamond particle used as the material has a larger diameter, the high-strength and highly-wear-resistant sintered diamond object attaining excellent chipping resistance, wear resistance, shock resistance, and thermal conductivity can be obtained by adding that element to the binder. An amount of added binder is not larger than in the conventional example, and the content of diamond is not smaller than in the conventional example. Therefore, lowering in wear resistance or the like is not likely.

The average particle size of the sintered diamond particle is set to not larger than 2 μm and preferably to not larger than 0.8 μm, because lowering in strength of the sintered diamond object due to cleavage of the diamond particle should be suppressed.

The reason why the content of the sintered diamond particle is set to not smaller than 80 volume % and less than 98 volume % is as follows. Specifically, if the content of the sintered diamond particle is set to less than 80 volume %, strength such as chipping resistance and shock resistance as well as wear resistance is lowered. Meanwhile, if the content of the diamond particle is set to not smaller than 98 volume %, the effect of the binder cannot sufficiently be obtained and neck growth does not develop.

The reason why the content of at least one element selected from the group consisting of Ti, Zr, Hf, V, Nb, Ta, Cr, and Mo is set to not smaller than 0.5 mass % and less than 50 mass % is as follows. Specifically, if the content of the element is less than 0.5 weight %, an effect of addition of the element for suppressing abnormal growth of the diamond particle is lowered. In addition, if the content of the element exceeds 50 weight %, an effect of the binder having catalyst capability for promoting neck growth of the diamond particle cannot sufficiently be obtained.

In the present invention, it is most effective to use Ti metal as the starting material, in order to attain both improvement in binding strength between the diamond particles and suppression of abnormal particle growth.

Originally, Ti does not attain catalysis for promoting neck growth between the diamond particles. In the present invention, however, it is assumed that an appropriate amount of Ti is added to a Co binder having catalyst capability for neck growth, so that Ti serves as the getter of excessive carbon without blocking catalysis of Co when carbon is dissolved in the binder. In addition, it is also assumed that Ti turns to carbide as a result of reaction with the diamond particle, so as to attain both improvement in binding strength between the diamond particles and suppression of abnormal particle growth.

W (tungsten), similarly to Ti, is also effective to some degree in suppressing abnormal particle growth. If the diamond particle has a particle size not larger than 1 μm, however, W is hardly effective in suppressing abnormal particle growth. In addition, if W is added instead of Ti, W is present as WC in the sintered diamond object. Therefore, if an Al (aluminum) metal is cut, Al disadvantageously tends to selectively adhere to WC in the sintered diamond object.

A specific method of manufacturing the sintered diamond object according to the present invention includes a method of crushing ceramics powder composed of at least one element selected from the group consisting of ultra-fine Ti, Zr, Hf, V, Nb, Ta, Cr, and Mo or carbide of that element by using a ball mill or the like, and mixing fine diamond powder with the same. Here, in order to use metal powder to implement a texture in which carbide in the sintered object is fine and present discontinuously, ultra-fine particles should be used as the starting material. As a normal metal material has ductility, it is only possible to obtain a particle having a several ten μm particle size. Therefore, the pool of the binder tends to be formed after sintering, which results in a defect. In order to obtain the sintered object of the present invention, it is preferable to use metal particle composed of Ti or the like obtained by an atomization method for obtaining ultra-fine metal particles having a particle size of not larger than several μm. Similarly, the Co alloy is also preferably fine, and it is preferable also to use ultra-fine metal powder of nanometer order obtained by a titanium redox method in which titanium ion reduction and oxidation reaction is combined.

The sintered object of the present invention can be obtained also by using ultra-fine ceramics powder composed of carbide of at least one element selected from the group consisting of ultra-fine Ti, Zr, Hf, V, Nb, Ta, Cr, and Mo. Further stronger bond with the diamond can be obtained, however, as a result of reaction and sintering of the diamond particle with metal powder, rather than using ceramics powder. Namely, it is preferable to employ a chemically active metal particle as the starting material, instead of a thermally and chemically stable ceramics particle. This is because, when the metal powder is used, the metal powder results a carbide through reaction with the diamond particle characterized by its low susceptibility to sintering, thereby forming strong bond with the diamond particles.

An ideal method of uniformly and discontinuously arranging at least one element selected from the group consisting of ultra-fine Ti, Zr, Hf, V, Nb, Ta, Cr, and Mo or ceramics composed of its carbide in the sintered diamond object includes a method of coating the surface of the diamond particle powder with the binder by using PVD (Physical Vapor Deposition). In particular, if sputtering is employed, the diamond particle is discontinuously coated with the binder containing an ultra-fine metal represented by Ti and having a particle size of approximately 10 to 100 nm and particularly of approximately 10 to 200 nm, whereby the sintered diamond object attaining particularly excellent chipping resistance and wear resistance can be obtained.

In the high-strength and highly-wear-resistant sintered diamond object according to the present invention, at least one element selected from the group consisting of Ti, Zr, Hf, V, Nb, Ta, Cr, and Mo is Ti, and the content of Ti in the binder phase is preferably at least 0.5 mass % and less than 20 mass %.

In the high-strength and highly-wear-resistant sintered diamond object according to the present invention, preferably, a test piece is cut out from the sintered diamond object in a planar rectangular shape having a length of 6 mm, a width of 3 mm, and a thickness in a range from at least 0.35 mm to at most 0.45 mm, and used for measuring transverse rupture strength under a condition of 4 mm span, and measured transverse rupture strength is at least 2.65 GPa.

In addition, in the high-strength and highly-wear-resistant sintered diamond object according to the present invention, preferably, the test piece cut out from the sintered diamond object in a planar rectangular shape having a length of 6 mm, a width of 3 mm, and a thickness in a range from at least 0.4 mm to at most 0.45 mm is subjected to dissolution treatment in a sealed container at a temperature in a range from at least 120° C. to lower than 150° C. for 3 hours by using fluoronitric acid obtained by mixing 40 ml of twice-diluted nitric acid having a concentration of at least 60% and less than 65% and 10 ml of hydrofluoric acid having a concentration from 45 to 50%, and thereafter the test piece is used for measuring transverse rupture strength under a condition of 4 mm span, and measured transverse rupture strength is at least 1.86 GPa.

In the high-strength and highly-wear-resistant sintered diamond object according to the present invention, preferably, at least one element selected from the group consisting of Ti, Zr, Hf, V, Nb, Ta, Cr, and Mo is Ti, and the content of Ti in the binder phase is at least 1 mass % and less than 20 mass %. In an X-ray diffraction pattern of the sintered diamond object measured under a condition of acceleration of electron beam of 40 kV, a current of 25 mA, an angle of diffraction $2\theta=20$ to 80°, and a scanning speed of 0.1° C./second, a diffraction beam of titanium carbide in a direction of (200) has an intensity ratio of at least 3% and less than 50% of a diffraction beam of the diamond in a direction of (111). Here, the "intensity of the X-ray diffraction beam" refers to a height of the peak in the X-ray diffraction pattern in which a CuKα beam (a characteristic X-ray generated from electron of K shell of Cu) is used.

The present inventors have also paid attention to oxygen or oxide adsorbed on a surface of diamond powder serving as a material for manufacturing the sintered diamond object, and have found that strength of the sintered diamond object is improved by removing oxygen or oxide to make smaller the defect present in the sintered object. Therefore, preferably, the sintered diamond object contains oxygen in an amount of at least 0.001 mass % and less than 0.15 mass %. The proportion of oxygen is set to at least 0.001 mass % and less than 0.15 mass %, because it is impossible to set the proportion of oxygen to less than 0.001 mass % with current technology, and because strength of the sintered diamond object is similar to that in the conventional example if it is set to not smaller than 0.15 mass %.

The sintered diamond object according to the present invention can suppress abnormal particle growth. Therefore, sintering at a higher pressure or temperature condition is also possible. Conventionally, in the industry, the pressure has been set to 5.5 GPa and the temperature has been set to approximately 1000° C. in general, that is, a necessary and sufficient pressure has been set. If a higher pressure is set as a sintering condition, fine diamond particles can be sintered to attain a higher content. Moreover, as a result of sintering at a higher pressure, neck growth can be promoted.

According to a method of manufacturing the high-strength and highly-wear-resistant sintered diamond object of the present invention, it is desirable to carry out sintering by holding for 10 minutes under a condition of a pressure in a range from not lower than 5.7 GPa to not higher than 7.5 GPa and a temperature in a range from not lower than 1500° C. to not higher than 1900° C. If the pressure is higher than 7.5 GPa, it is not practical in view of durability of a mold of an extra-high-pressure generator. If the temperature higher than 1900° C. is set, an equilibrium line of diamond-graphite is exceeded and a graphite stable region is entered. In such a case, graphitization of diamond occurs. Taking into consideration durability of the mold of the extra-high-pressure generator and performance of the sintered diamond object, sintering by holding for 10 minutes under a condition of a pressure in a range from not lower than 6.0 GPa and not higher than 7.2 GPa and a temperature in a range from not lower than 1500° C. to not higher than 1900° C. is more preferable.

Effects of the Invention

According to the high-strength and highly-wear-resistant sintered diamond object and the method of manufacturing the same of the present invention, particle growth can be suppressed without using the hard particle having low affinity with the diamond particle. Therefore, direct bond between the diamond particles can further be strengthened. As a result, the high-strength and highly-wear-resistant sintered diamond object attaining excellent wear resistance, chipping resistance, shock resistance, and thermal conductivity can be obtained.

BEST MODES FOR CARRYING OUT THE INVENTION

Figure 1:
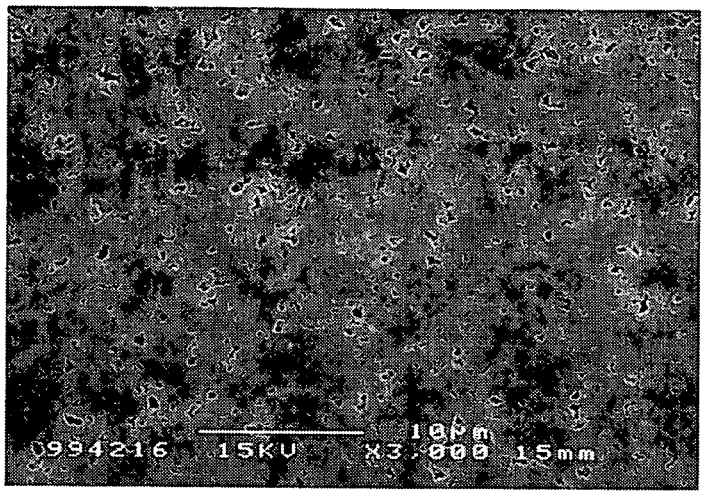
FIG. 1 is a micrograph showing a texture of a sample 1E in Example 1.

An embodiment of the present invention will be shown in examples below.

EXAMPLE 1

In the present example, an average particle size of the sintered diamond object powder, the content of the sintered diamond particle in the sintered diamond object, and a composition of the binder are varied and the transverse rupture strength and a flank wear amount were measured. Specifically, a vacuum furnace containing a rotary mixer was used to dry-blend the diamond powder having an average particle size of 0.8 μm and mixture powder of Co metal and Ti metal serving as the binder under such a condition as a degree of vacuum of 0.1 Pa, a furnace temperature of 300° C., and the number of revolutions of 2000 rpm. The blended diamond powder and various binders were filled in a container made of Ta (tantalum) in a state that the mixture was in contact with a disk made of WC-6% Co hardmetal, and held for sintering for 10 minutes under a condition of a pressure from 5.7 GPa to 7.2 GPa and a temperature from 1500° C. to 1900° C. by using a belt-type extra-high-pressure apparatus. A sample in which Ti was added was presented for observation of the texture on the surface of the completed sintered object, so as to determine whether Ti is present continuously or discontinuously. The diamond particle that has grown to a particle size of not smaller than 300 μm during sintering was considered as the abnormally grown particle, and the number of such particles was counted. All sintered objects were worked into bar-shaped test pieces having a dimension of 6×3×0.3 mm, and thereafter its transverse rupture strength was measured in a three-point bending test under a condition of 4 mm span. In addition, a sintered object chip for cutting (ISO standard: TPGN160304) having a main surface shaped in a regular triangle was fabricated and subjected to a cutting test, in which a flank wear amount was measured. In the cutting test, an Al (aluminum) alloy round rod containing 16 mass % Si was used as a material to be cut, and the test was conducted with the use of a cutting liquid under a working condition of a cutting speed of 800 m/min, a cutting depth of 0.5 mm, a feed speed of 0.12 mm/rev, and a cutting time period of 5 minutes. The result is shown in Table 1. In Table 1, the sintered diamond object according to the present invention is represented by samples 1E and 1G. As a result of X-ray analysis of samples 1E and 1G, it was found that a part of added Ti was present as TiC.

TABLE 1

| Sintered Object Sample | Average Particle Size of Diamond Particle (μm) | Content of Diamond Particle (Volume %) | Prepared Composition of Binder (Mass %) | Composition of Binder Phase of Sintered Object (Mass %) | Manner of Presence of Ti | Count of Abnormally Grown Particle (Count) | Sintering Condition Pressure (GPa) | Sintering Condition Temperature (° C.) | Transverse Rupture Strength (GPa) | Flank Wear Amount (μm) |
|---|---|---|---|---|---|---|---|---|---|---|
| 1A | 0.8 | 78 | Co: 100% | Co: 95.2%, W: 2.8% | — | 258 | 5.7 | 1500 | 1.35 | 77 |
| 1B | 0.8 | 78 | Co: 75%, Ti: 25% | Co: 77.5%, Ti: 16.0%, W: 2.8% | Discontinuous | 0 | 5.8 | 1500 | 2.54 | 65 |
| 1C | 0.8 | 78 | Co: 75%, W: 25% | Co: 71.2%, W: 23.8% | — | 11 | 5.7 | 1500 | 2.30 | 70 |
| 1D | 0.8 | 90 | Co: 100% | Co: 94.8%, W: 2.2% | — | 231 | 6.2 | 1600 | 1.42 | 72 |
| 1E | 0.8 Present Invention | 90 | Co: 75%, Ti: 25% | Co: 77.8%, Ti: 16.1%, W: 2.4% | Discontinuous | 0 | 7.2 | 1900 | 2.85 | 43 |

TABLE 1-continued

| Sintered Object Sample | Average Particle Size of Diamond Particle (μm) | Content of Diamond Particle (Volume %) | Prepared Composition of Binder (Mass %) | Composition of Binder Phase of Sintered Object (Mass %) | Manner of Presence of Ti | Count of Abnormally Grown Particle (Count) | Sintering Condition Pressure (GPa) | Sintering Condition Temperature (° C.) | Transverse Rupture Strength (GPa) | Flank Wear Amount (μm) |
|---|---|---|---|---|---|---|---|---|---|---|
| 1F | 0.8 | 90 | Co: 75%, W: 25% | Co: 70.4%, W: 25.6% | — | 18 | 6.8 | 1800 | 2.35 | 56 |
| 1G | 0.8 Present Invention | 90 | Co: 50%, Ti: 50% | Co: 44.6%, Ti: 46.2%, W: 1.9% | Discontinuous | 0 | 7.0 | 1900 | 2.76 | 49 |
| 1H | 0.8 | 90 | Co: 50%, W: 50% | Co: 56.2%, W: 40.8% | — | 3 | 6.7 | 1750 | 2.26 | 61 |
| 1I | 0.8 | 90 | Co: 40%, Ti: 60% | Co: 31.9%, Ti: 51.8%, W: 2.6% | Continuous | 0 | 6.5 | 1600 | 2.03 | 68 |
| 1J | 0.8 | 90 | Co: 99.5%, Ti: 0.5% | Co: 93.5%, Ti: 0.2%, W: 2.3% | Discontinuous | 215 | 6.8 | 1900 | 1.41 | 71 |
| 1K | 2.5 | 90 | Co: 100% | Co: 90.9%, W: 6.1% | — | 1 | 6.5 | 1600 | 1.94 | 57 |
| 1L | 2.5 | 90 | Co: 75%, Ti: 25% | Co: 76.5%, Ti: 16.8%, W: 2.7% | Discontinuous | 0 | 6.5 | 1600 | 1.85 | 58 |
| 1M | 2.5 Conventional Product | 85 | Co: 75%, W: 25% | Co: 70.1%, W: 25.9% | — | 0 | 6.0 | 1600 | 1.78 | 61 |
| 1N | 0.8 | 99 | Co: 75%, Ti: 25% | Co: 76.8%, Ti: 14.1%, W: 5.1% | Discontinuous | 0 | 7.2 | 1900 | 2.03 | 69 |

As shown in Table 1, in samples 1A and 1D in which 100 mass % Co was used as a prepared composition of the binder and diamond powder has an average particle size of 0.8 μm, a large number of abnormally grown particles (258 and 231 particles) were observed in sample 1A and sample 1D respectively. In addition, some abnormally grown particles (11, 8 and 3 particles) were generated in 1C, 1F, and 1H respectively, in which W was added to the binder. On the other hand, in samples 1B, 1E, 1G, 1I, and 1N in which the binder phase contains at least 0.5 mass % Ti and diamond powder has an average particle size of 0.8 μm, abnormal particle growth was hardly observed. Therefore, it can be seen that abnormal particle growth can be suppressed by containing at least 0.5 mass % Ti in the binder phase.

In addition, when comparison is made between sample 1E in which diamond powder has an average particle size of 0.8 μm and sample 1L in which diamond powder has an average particle size of 2.5 μm, transverse rupture strength of sample 1E is larger than that of sample 1L. Therefore, it can be seen that chipping resistance is improved by setting the average particle size of the diamond particle to not larger than 2 μm.

Moreover, when comparison is made between samples 1B and 1C containing 78 volume % sintered diamond particle and samples 1E and 1F containing 90 volume % sintered diamond particle, the transverse rupture strength of samples 1E and 1F is larger than that of samples 1B and 1C, and flank wear amount of samples 1E and 1F is smaller than that of samples 1B and 1C. Therefore, it can be seen that chipping resistance and wear resistance are improved by setting the content of the sintered diamond particle to not smaller than 80 volume %.

Furthermore, when comparison is made between sample 1E containing 16.1 mass % Ti in the binder phase and sintered under the condition of a pressure of 7.2 GPa and a temperature of 1900° C. and sample 1F containing 25.6 mass % W in the binder phase and sintered under the condition of a pressure of 6.8 GPa and a temperature of 1800° C., the transverse rupture strength of sample 1E is larger than that of sample 1F, and flank wear amount of sample 1E is smaller than that of sample 1F. When comparison is made between sample 1G containing 46.2 mass % Ti in the binder phase and sintered under the condition of a pressure of 7.0 GPa and a temperature of 1900° C. and sample 1H containing 40.8 mass % W in the binder phase and sintered under the condition of a pressure of 6.7 GPa and a temperature of 1750° C., the transverse rupture strength of sample 1G is larger than that of sample 1H, and flank wear amount of sample 1G is smaller than that of sample 1H. As abnormal particle growth can be suppressed by containing Ti in the binder phase, a pressure and a temperature representing sintering conditions can be set higher. Therefore, it can be seen that chipping resistance and wear resistance can be improved.

Samples 1E and 1G according to the present invention attain higher transverse rupture strength and smaller flank wear amount than sample 1M representing a conventional product. In addition, it can be seen that abnormal particle growth did not occur in sample 1K having an average particle size of not smaller than 2 μm even if Ti was not added. Sample 1N containing 99 mass % diamond particle attains low transverse rupture strength and large flank wear amount. Therefore, it can be seen that neck growth achieved by the binder is insufficient.

EXAMPLE 2

In the present example, an average particle size of Ti contained in the binder was varied and the transverse rupture strength and the flank wear amount were measured. Specifically, a ball mill was used to blend the diamond powder having an average particle size of 0.8 μm and attaining the content of 90 volume % and the binder containing 75 mass % Co and 25 mass % Ti. Ti in the binder having different average particle sizes of 0.1 μm, 0.8 μm, 0.9 μm, and 1.0 μm was used. Thereafter, a belt-type extra-high-pressure apparatus was used for sintering, in which the mixture was held for 10 minutes under a condition of a pressure of 7.2 GPa and a temperature of 1900° C. The transverse rupture strength of the obtained sintered object was measured by using the method the same as in Example 1 and the flank wear amount thereof was measured through a cutting test. The result is shown in Table 2.

TABLE 2

| Sintered Object Sample | Average Particle Size of Diamond Particle (μm) | Content of Diamond Particle (%) | Composition of Binder (Mass %) | Composition of Binder Phase of Sintered Object (Mass %) | Particle Size of Ti (μm) | Count of Abnormally Grown Particle (Count) | Transverse Rupture Strength (GPa) | Flank Wear Amount (μm) |
|---|---|---|---|---|---|---|---|---|
| 2A Present Invention | 0.8 | 90 | Co: 75%, Ti: 25% | Co: 78.0%, Ti: 16.2%, W: 3.1% | 0.1 | 0 | 2.85 | 43 |
| 2B Present Invention | 0.8 | 90 | Co: 75%, Ti: 25% | Co: 77.5%, Ti: 16.0%, W: 2.8% | 0.8 | 0 | 2.79 | 46 |
| 2C Comparative Product | 0.8 | 90 | Co: 75%, Ti: 25% | Co: 77.8%, Ti: 16.1%, W: 2.9% | 0.9 | 3 | 2.46 | 48 |
| 2D Comparative Product | 0.8 | 90 | Co: 75%, Ti: 25% | Co: 76.8%, Ti: 16.5%, W: 2.6% | 1.0 | 25 | 2.01 | 50 |
| 2E Present Invention | 0.8 | 90 | Co: 50%, Ti: 50% | Co: 45.1%, Ti: 46.1%, W: 2.0% | 0.1 | 0 | 2.69 | 60 |
| 2F Present Invention | 0.8 | 90 | Co: 50%, Ti: 50% | Co: 44.6%, Ti: 46.2%, W: 1.9% | 0.8 | 0 | 2.66 | 63 |
| 2G Comparative Product | 0.8 | 90 | Co: 50%, Ti: 50% | Co: 44.1%, Ti: 45.7%, W: 2.1% | 0.9 | 4 | 2.26 | 66 |
| 2H Comparative Product | 0.8 | 90 | Co: 50%, Ti: 50% | Co: 42.9%, Ti: 46.8%, W: 2.3% | 1.0 | 25 | 2.06 | 65 |

As shown in Table 2, the flank wear amounts of samples 2A to 2D are substantially the same, and the flank wear amounts of samples 2E to 2H are substantially the same. Meanwhile, the transverse rupture strength of samples 2A and 2B is larger than that of samples 2C and 2D, and the transverse rupture strength of samples 2E and 2F is larger than that of samples 2G and 2H. In addition, the number of diamond particles that have grown to a particle size of not smaller than 300 μm during sintering was counted. Consequently, abnormal particle growth was not observed in samples 2A, 2B, 2E, and 2. On the other hand, abnormal particle growth was observed in samples 2C, 2D, 2G, and 2H (3, 25, 4, and 25 particles respectively). Therefore, it can be seen that setting the average particle size of Ti in the binder to not larger than 0.8 μm effectively suppresses abnormal particle growth, and chipping resistance is improved because neck growth is not suppressed.

EXAMPLE 3

In the present example, a method of adding Ti that should be added to the binder was varied and the transverse rupture strength and the flank wear amount were measured. Specifically, a sample 3A was prepared by blending, by means of the ball mill, diamond powder having an average particle size of 0.8 μm and attaining the content of 90 volume % and the binder containing 75 mass % Co and 25 mass % Ti. In addition, a sample 3B having a similar composition was prepared by coating the diamond powder with Ti by using an RF (Radio Frequency) sputtering PVD apparatus. Moreover, a sample 3C having a similar texture was prepared by coating the diamond powder with Ti by using a CVD (Chemical Vapor Deposition) apparatus such that a coating layer has a thickness of 0.1 μm on an entire surface of the diamond particle. Each of samples 3A to 3C was filled in a container made of Ta (tantalum) in a state that the sample is in contact with a disk made of WC-6% Co hardmetal, and held for sintering for 10 minutes under a condition of a pressure of 7.2 GPa and a temperature of 1900° C. by using a belt-type extra-high-pressure apparatus. The transverse rupture strength of the obtained sintered object was measured by using the method the same as in Example 1 and the flank wear amount thereof was measured in a cutting test. The result is shown in Table 3.

TABLE 3

| Sintered Object Sample | Average Particle Size of Diamond Particle (μm) | Content of Diamond Particle (%) | Composition of Binder (Mass %) | Composition of Binder Phase of Sintered Object (Mass %) | Particle Size of Ti (μm) | Method of Adding Ti | Transverse Rupture Strength (GPa) | Flank Wear Amount (μm) |
|---|---|---|---|---|---|---|---|---|
| 3A | 0.8 | 90 | Co: 75%, Ti: 25% | Co: 79.8%, Ti: 17.1%, W: 3.1% | 0.1 | Blending with Ball Mill | 2.59 | 53 |
| 3B | 0.8 | 90 | Co: 75%, Ti: 25% | Co: 79.8%, Ti: 17.0%, W: 3.2% | 0.1 | PVD | 2.88 | 39 |

TABLE 3-continued

| Sintered Object Sample | Average Particle Size of Diamond Particle (μm) | Content of Diamond Particle (%) | Composition of Binder (Mass %) | Composition of Binder Phase of Sintered Object (Mass %) | Particle Size of Ti (μm) | Method of Adding Ti | Transverse Rupture Strength (GPa) | Flank Wear Amount (μm) |
|---|---|---|---|---|---|---|---|---|
| 3C | 0.8 | 90 | Co: 75%, Ti: 25% | Co: 79.6%, Ti: 17.2%, W: 3.2% | Coating Layer, approx. 0.1 | CVD | 2.46 | 55 |

As shown in Table 3, sample 3B coated by using the RF sputtering PVD apparatus exhibited the transverse rupture strength and the flank wear amount superior to sample 3A in which Ti was added by blending by means of the ball mill and sample 3C in which the diamond particle was coated with Ti by using the CVD method. The texture and the surface of each sample were observed by using a metallurgical microscope. In sample 3A, segregation of Co or Ti was observed and the uniform texture was not obtained. In addition, the average particle size of Ti carbide was 1.0 μm, which was larger than that at the time of addition. In samples 3B and 3C, segregation of Co or Ti was not observed and the uniform texture was obtained. In sample 3C, however, the texture of TiC was continuous, because the entire surface of the diamond particle was uniformly coated, and not only abnormal particle growth but also neck growth between the diamond particles were suppressed. In sample 3B, coating of the diamond particle with Ti was not entirely uniform but partial, that is, discontinuous, and the average particle size of Ti powder was maintained at approximately 0.1 μm. Therefore, it was found that Ti is preferably added by coating by means of the RF sputtering PVD apparatus. It was also found that lowering in the transverse rupture strength or increase in the flank wear amount is caused if carbide has an average particle size larger than 0.8 μm or if the texture of the carbide itself is continuous.

EXAMPLE 4

In the present example, variation in the transverse rupture strength when samples 3A to 3C in Example 3 were subjected to dissolution treatment was observed. Specifically, a test piece cut out from the sintered diamond object represented by samples 3A to 3C in Example 3 in a planar rectangular shape having a length of 6 mm, a width of 3 mm, and a thickness of 0.4 to 0.45 mm was subjected to dissolution treatment in a sealed container at a temperature of not lower than 120° C. and lower than 150° C. for 3 hours by using fluoro-nitric acid obtained by mixing 40 ml of twice-diluted nitric acid having a concentration of at least 60% and less than 65% and 10 ml of hydrofluoric acid having a concentration from 45 to 50%. Among the test pieces (samples) obtained in the above-described manner, a sample that had been identified as sample 3A was identified as a sample 4A, a sample that had been identified as sample 3B was identified as a sample 4B, and a sample that had been identified as sample 3C was identified as a sample 4C. Using each sample, the transverse rupture strength was measured under a condition of 4 mm span. The result is shown in Table 4.

TABLE 4

| Sintered Object Sample | Average Particle Size of Diamond Particle (μm) | Content of Diamond Particle (%) | Composition of Binder (Mass %) | Composition of Binder Phase of Sintered Object (Mass %) | Particle Size of Ti (μm) | Method of Adding Ti | Transverse Rupture Strength (GPa) | Dissolution Treatment |
|---|---|---|---|---|---|---|---|---|
| 4A | 0.8 | 90 | Co: 75%, Ti: 25% | Co: 79.8%, Ti: 17.1%, W: 3.1% | 0.1 | Blending with Ball Mill | 2.02 | Yes |
| 4B | 0.8 | 90 | Co: 75%, Ti: 25% | Co: 79.8%, Ti: 17.0%, W: 3.2% | 0.1 | PVD | 2.59 | Yes |
| 4C | 0.8 | 90 | Co: 75%, Ti: 25% | Co: 79.6%, Ti: 17.2%, W: 3.2% | Coating Layer, approx. 0.1 | CVD | 1.98 | Yes |

As shown in Table 4, the transverse rupture strength of sample 4B, in which Ti was added by using the RF sputtering PVD apparatus, reduced solely by 0.22 GPa, from 2.88 GPa to 2.59 GPa. In contrast, the transverse rupture strength of sample 4A, in which Ti was added by blending by means of the ball mill, significantly reduced by 0.57 GPa, from 2.59 GPa to 2.02 GPa. In addition, the transverse rupture strength of sample 4C, in which Ti was added by using CVD, also significantly reduced by 0.48 GPa, from 2.46 GPa to 1.98 GPa. Therefore, it can be seen that neck growth between the diamond particles has developed and a strong structure has been formed by adding Ti by means of the RF sputtering PVD apparatus, that is, by developing a discontinuous texture of Ti itself.

EXAMPLE 5

In the present example, a proportion of Ti in the binder was varied and an intensity ratio between the diffraction beam of TiC in a direction of (200) and the diffraction beam of diamond in a direction of (111) in the obtained sintered object was measured. Specifically, three types of samples were prepared: a sample 5A containing 78 volume % diamond powder and a material to be sintered containing 75 mass % Co and 25 mass % Ti; a sample 5B containing 90 volume % diamond powder and a material to be sintered containing 75 mass % Co and 25 mass % Ti; and a sample 5C containing 90 volume % diamond powder and a material to be sintered containing 50 mass % Co and 50 mass % Ti. In all samples, the average particle size of the diamond powder was set to 0.8 μm. Thereafter, a belt-type extra-high-pressure apparatus was used for sintering, in which the sample was held for 10 minutes under a condition of a pressure of 7.2 GPa and a temperature of 1900° C. A characteristic X-ray generated from electron of K shell of Cu was used to measure an X-ray diffraction pattern of the obtained sintered diamond object under a condition of acceleration of electron beam for irradiating a Cu target of 40 kV, a current of 25 mA, an angle of diffraction 2θ=20 to 80°, and a scanning speed of 0.1° C./second, and the intensity ratio between the diffraction beam of TiC in the direction of (200) and the diffraction beam of diamond in a direction of (111) was measured. The result is shown in Table 5. In Table 5, sample 5B represents the sintered diamond object according to the present invention.

TABLE 5

| Sintered Object Sample | Average Particle Size of Diamond Particle (μm) | Content of Diamond Particle (Volume %) | Composition of Material to be Sintered (Mass %) | Composition of Binder Phase of Sintered Object (Mass %) | Intensity Ratio of X-Ray Diffraction | Flank Wear Amount (μm) |
|---|---|---|---|---|---|---|
| 5A | 0.8 | 78 | Co: 75%, Ti: 25% | Co: 79.8%, Ti: 17.1%, W: 3.1% | 57% | 65 |
| 5B | 0.8 | 90 | Co: 75%, Ti: 25% | Co: 79.8%, Ti: 17.0%, W: 3.2% | 40% | 39 |
| 5C | 0.8 | 90 | Co: 40%, Ti: 60% | Co: 31.9%, Ti: 51.8%, W: 2.6% | 61% | 68 |

As shown in Table 5, the X-ray diffraction intensity ratio of sample 5B attaining the smallest flank wear amount was 40%. On the other hand, samples 5A and 5C attained the intensity ratio larger than 50%. Therefore, it can be seen that the flank wear amount tends to increase in a sample attaining the intensity ratio of TiC exceeding 50%. In addition, it can also be seen that the intensity ratio of the diffraction beam of TiC in a direction of (200) is preferably in a range of not lower than 0.01% and less than 50% of the diffraction beam of diamond in a direction of (111), because abnormal particle growth occurs in the sintered object without containing Ti in the binder composition.

EXAMPLE 6

In the present example, an amount of oxygen contained in the sintered diamond object was varied and the transverse rupture strength and the flank wear amount were measured. Specifically, the diamond powder having an average particle size of 0.8 μm and attaining the content of 90 volume % and the binder containing 75 mass % Co and 25 mass % Ti were blended. Thereafter, the resultant mixtures were subjected to thermal treatment for 60 minutes in vacuum at temperatures of 1000° C., 1100° C., and 1250° C. respectively, so as to reduce the binder and partially graphitize the diamond particle from the surface. Thereafter, a belt-type extra-high-pressure apparatus was used for sintering, in which the sample was held for 10 minutes under a condition of a pressure of 7.2 GPa and a temperature of 1900° C. Among the obtained samples, a sample that had been subjected to thermal treatment at the temperature of 1000° C. was identified as a sample 6A; a sample that had been subjected to thermal treatment at the temperature of 1100° C. was identified as a sample 6B; and a sample that had been subjected to thermal treatment at the temperature of 1250° C. was identified as a sample 6C. An amount of oxygen contained in samples 6A to 6C was measured by using ICP (Inductively Coupled Plasma). In addition, the transverse rupture strength of samples 6A to 6C was measured with the method the same as in Example 1. The result is shown in Table 6.

TABLE 6

| Sintered Object Sample | Average Particle Size of Diamond Particle (μm) | Content of Diamond Particle (Volume %) | Composition of Material to be Sintered (Mass %) | Composition of Binder Phase of Sintered Object (Mass %) | Heating Temperature (° C.) | Oxygen Content (Mass %) | Transverse Rupture Strength (GPa) |
|---|---|---|---|---|---|---|---|
| 6A | 0.8 | 90 | Co: 75%, Ti: 25% | Co: 79.8%, Ti: 17.1%, W: 3.1% | 1050 | 0.20 | 2.04 |
| 6B | 0.8 | 90 | Co: 75%, Ti: 25% | Co: 79.8%, Ti: 17.0%, W: 3.2% | 1150 | 0.14 | 2.44 |

TABLE 6-continued

| Sintered Object Sample | Average Particle Size of Diamond Particle (μm) | Content of Diamond Particle (Volume %) | Composition of Material to be Sintered (Mass %) | Composition of Binder Phase of Sintered Object (Mass %) | Heating Temperature (° C.) | Oxygen Content (Mass %) | Transverse Rupture Strength (GPa) |
|---|---|---|---|---|---|---|---|
| 6C | 0.8 | 90 | Co: 75%, Ti: 25% | Co: 79.6%, Ti: 17.2%, W: 3.2% | 1250 | 0.05 | 2.59 |

As shown in Table 6, if the temperature for thermal treatment before sintering was changed, an amount of oxygen contained in the sintered diamond object varied. If the amount of oxygen is not larger than 0.15 mass %, the transverse rupture strength is significantly improved. Therefore, it can be seen that chipping resistance is improved by containing oxygen in an amount of less than 0.15 mass %.

EXAMPLE 7

Figure 2:
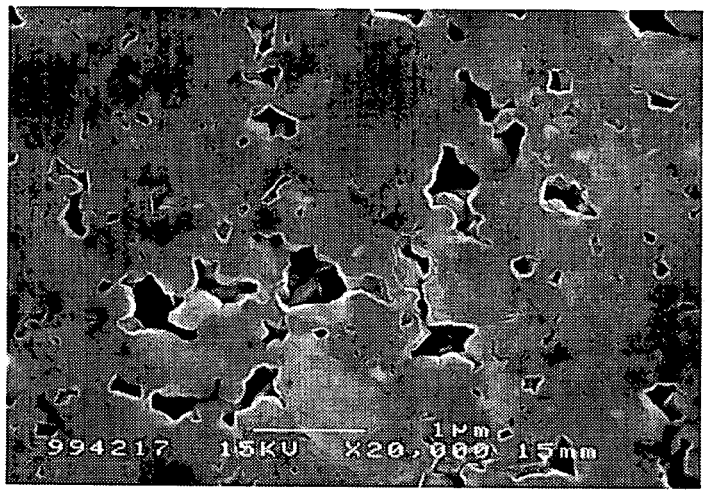
FIG. 2 is a micrograph in a magnification higher than in FIG. 1, showing the texture of sample 1E.
Figure 3:
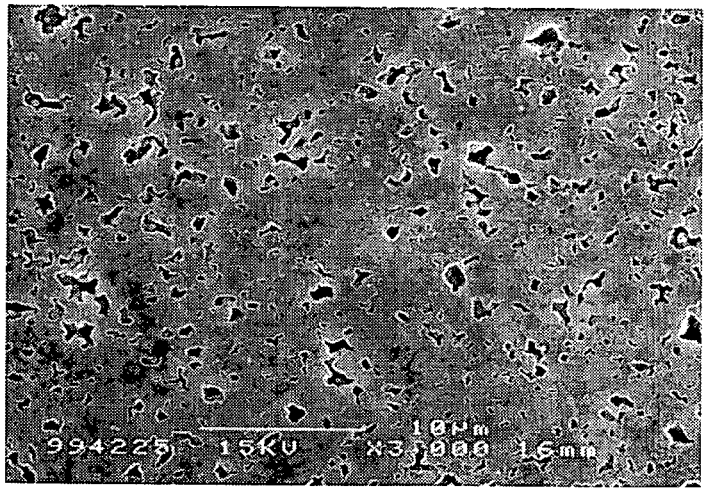
FIG. 3 is a micrograph showing a texture of a sample 1H in Example 1.
Figure 4:
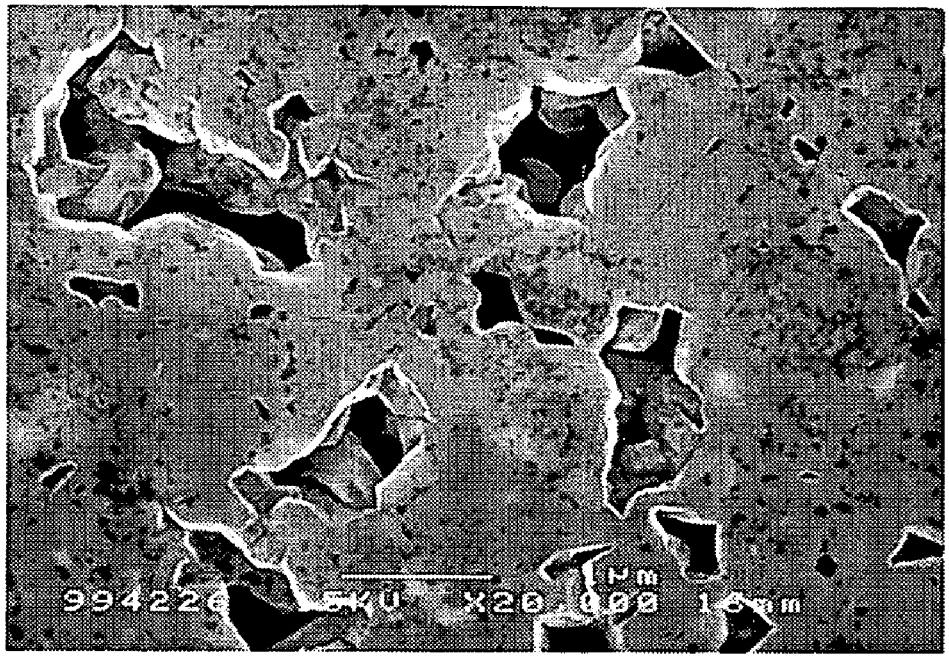
FIG. 4 is a micrograph in a magnification higher than in FIG. 3, showing the texture of sample 1H.

In the present example, the sintered diamond objects represented as sample 1E (present invention) and sample 1H (conventional example) in Example 1 were treated with acid and microphotographed. FIG. 1 is a micrograph showing a texture of sample 1E in Example 1. FIG. 2 is a micrograph in a magnification higher than in FIG. 1, showing the texture of sample 1E. FIG. 3 is a micrograph showing a texture of sample 1H in Example 1. FIG. 4 is a micrograph in a magnification higher than in FIG. 3, showing the texture of sample 1H.

Referring to FIGS. 1 to 4, a plurality of small holes scattered on the whole surface correspond to portions that were the binder phase. The volume of the binder phase in FIGS. 1 and 2 showing the sintered diamond object according to the present invention is smaller than the volume of the binder phase in FIGS. 3 and 4 showing the conventional sintered diamond object. Therefore, it can be seen that the neck growth of the diamond particles is not blocked by the binder phase in the present invention.

Figure 5:
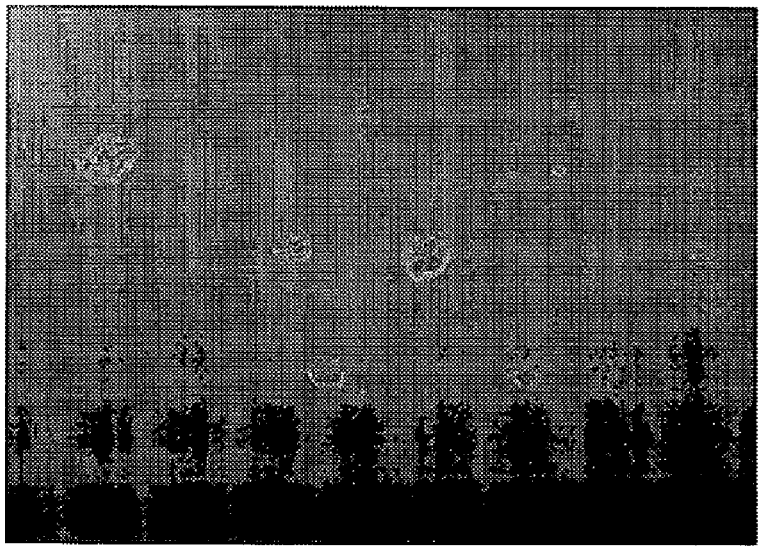
FIG. 5 is a micrograph showing a texture of sintered diamond object in which particle has abnormally grown.

FIG. 5 is a micrograph showing a texture of the sintered diamond object in which particle has abnormally grown. Referring to FIG. 5, a small spot represents the diamond particle that has abnormally grown. The diamond particle that has abnormally grown has a particle size of not smaller than 300 μm. A large number of such abnormally grown particles were observed in the conventional sintered diamond object. The present invention can suppress such abnormally grown particle.

The examples disclosed above are by way of illustration and are not to be taken by way of limitation, the spirit and scope of the present invention being limited not by the examples above but by the claims and intended to include all modifications and variations within the scope of the claims. ductivity can thus be obtained.

The invention claimed is:

1. A high-strength and highly-wear-resistant sintered diamond object comprising sintered diamond particle having an average particle size of at most 2 μm and a binder phase as a remaining portion, wherein content of said sintered diamond particle in said sintered diamond object is at least 80 volume % and at most 98 volume %, said binder phase contains at least titanium, of which content is at least 0.5 mass % and less than 20 mass %, and contains cobalt, of which content is at least 50 mass % and less than 99.5 mass %, a part of said Ti or said Ti as a whole is present as carbide particle having an average particle size of at most 0.8 μm, a texture of said carbide particle is discontinuous, and adjacent said diamond particles are bound to each other.

2. The high-strength and highly-wear-resistant sintered diamond object according to claim 1, wherein a test piece is cut out from said sintered diamond object in a planar rectangular shape having a length of 6 mm, a width of 3 mm and a thickness in a range from at least 0.4 mm to at most 0.45 mm and used for measuring transverse rupture strength under a condition of 4 mm span, and measured transverse rupture strength is at least 2.65 GPa.

3. The high-strength and highly-wear-resistant sintered diamond object according to claim 1, wherein a test piece cut out from said sintered diamond object in a planar rectangular shape having a length of 6 mm, a width of 3 mm and a thickness in a range from at least 0.4 mm to at most 0.45 mm is subjected to dissolution treatment in a sealed container at a temperature in a range from at least 120° C. to less than 150° C. for 3 hours by using fluoro-nitric acid obtained by mixing 40 ml of twice-diluted nitric acid having a concentration of at least 60% and less than 65% and 10 ml of hydrofluoric acid having a concentration from 45 to 50%, and thereafter the test piece is used for measuring transverse rupture strength under a condition of 4 mm span, and measured transverse rupture strength is at least 1.86 GPa.

4. The high-strength and highly-wear-resistant sintered diamond object according to claim 1, wherein in an X-ray diffraction pattern of said sintered diamond object measured under a condition of acceleration of electron beam of 40 kV, a current of 25 mA, an angle of diffraction 2θ=20 to 80°, and a scanning speed of 0.1°C./second, a diffraction beam of titanium carbide in a direction of (200) attains an intensity ratio of at least 3% and less than 50% of a diffraction beam of diamond in a direction of (111).

5. The high-strength and highly-wear-resistant sintered diamond object according to claim 1, wherein said sintered diamond object contains oxygen in an amount of at least 0.001 mass % and less than 0.15 mass

6. A method of manufacturing the high-strength and highly-wear-resistant sintered diamond object according to claim 1, wherein sintering is performed under a condition of a pressure in a range from at least 5.7 GPa to at most 7.5 GPa and a temperature in a range from at least 1400° C. to at most 1900° C., using a belt-type extra-high-pressure apparatus.

7. The method of manufacturing high-strength and highly-wear-resistant sintered diamond object according to claim 6, wherein sintering is performed under a condition of a pressure in a range from at least 6.0GPa to at most 7.2 GPa and a temperature in a range from at least 1400° C. to at most 1900° C., using a belt-type extra-high-pressure apparatus.

* * * * *